US006354042B1

(12) United States Patent
Kuo

(10) Patent No.: US 6,354,042 B1
(45) Date of Patent: Mar. 12, 2002

(54) UMBRELLA RUNNER STRUCTURE

(76) Inventor: Shih-Shin Kuo, 8F, No. 39, Sau Nien Street, Hsinchu City (TW)

( * ) Notice: Subject to any disclaimer, the term of this patent is extended or adjusted under 35 U.S.C. 154(b) by 0 days.

(21) Appl. No.: 09/655,860

(22) Filed: Sep. 6, 2000

(51) Int. Cl.[7] ..... A45B 25/06
(52) U.S. Cl. ..... 52/28
(58) Field of Search ..... 135/38, 39, 28, 135/41, 20.3

(56) References Cited

U.S. PATENT DOCUMENTS 5,615,698 A * 4/1997 Ko ..... 135/28
5,732,725 A * 3/1998 Ko ..... 135/28
5,911,233 A * 6/1999 Wu ..... 135/28
5,964,235 A * 10/1999 Wang ..... 135/28
6,006,771 A * 12/1999 Wu ..... 135/41
6,192,907 B1 * 2/2001 Wu ..... 135/28

* cited by examiner

*Primary Examiner*—Laura A. Callo
(74) *Attorney, Agent, or Firm*—Rosenberg, Klein & Lee

(57) ABSTRACT

An improved umbrella runner structure is disclosed. The improvements are primarily the design of partition flanges on the top face of the runner. Two thick partition flanges in conjunction with two coupling portions of the runner form four compartments arranged symmetrically. Each compartment can accommodate the inner ends of two stretchers so that a total of eight stretchers are attached to the runner to form an eight-stretcher system. The umbrella stretcher system using the runner according to the invention has the advantage of enhanced strength and simplified construction and it can reduce the possibility of being damaged while it can reach a more compact size than a prior art one. Besides, it also provides convenience in carrying.

2 Claims, 3 Drawing Sheets

UMBRELLA RUNNER STRUCTURE

BACKGROUND OF THE INVENTION

Most of prior art runners used on an umbrella stretcher system composed of eight stretchers have a structure as shown in FIG. 1. The runner structure is provided with six spaced radial flanges (1) that are in conjunction with two raised coupling portions oppositely arranged in a diametrical direction to form eight compartments accommodating the inner ends of eight stretchers (2) respectively The stretchers are fixed in position by a steel wire. Such a structure is complex in configuration and also weak in strength due to thin flange thickness. Thus it often leads to a damaged runner. Besides, restrained by the flanges, the umbrella when collapsed can not reach its most compact size. Therefore, it is desirable to have improvements made on such deficiencies.

In view of above drawbacks, the primary object of the invention is to provide an improved umbrella runner structure that has a simplified construction and can achieve better performance. Now the features and advantages of the invention will be described in detail with reference to the concomitant drawings.

BRIEF DESCRIPTION OF ACCOMPANYING DRAWINGS

DETAILED DESCRIPTION OF THE INVENTION

Figure 2:
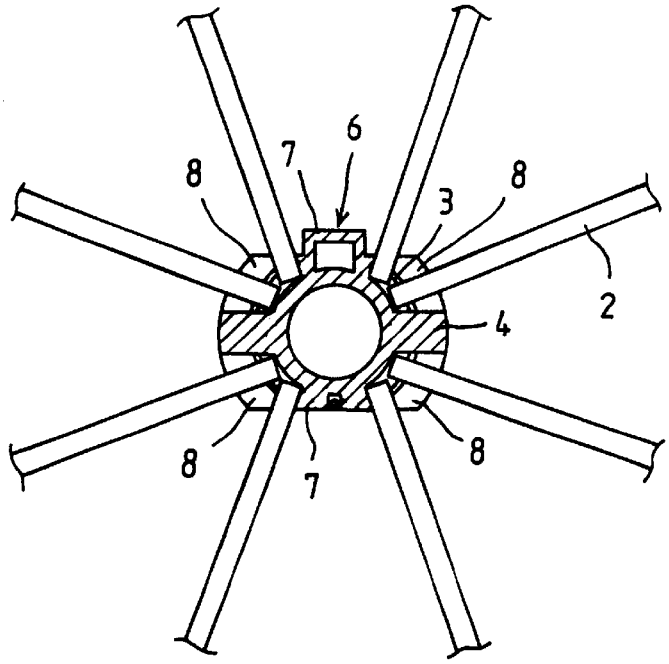
FIG. 2 is a schematic plan view showing an umbrella runner structure according to the present invention.
Figure 1:
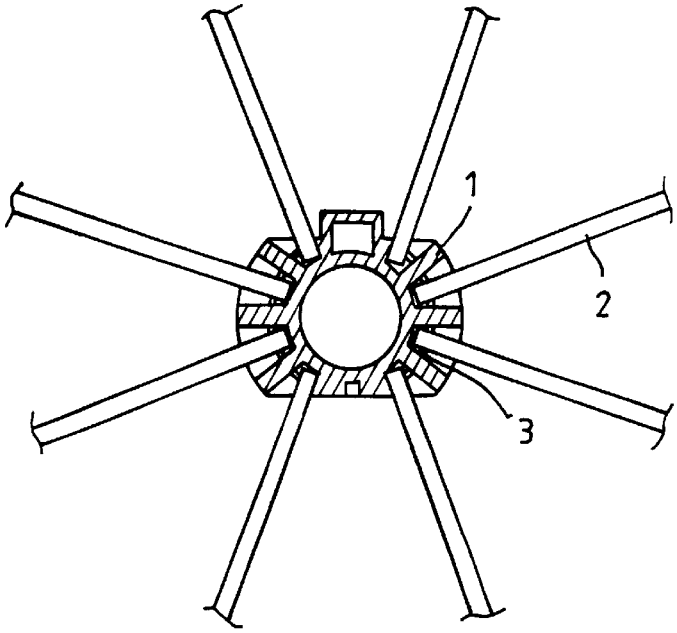
FIG. 1 (prior art)
FIG. 1 is a schematic plan view showing an umbrella runner structure according to a prior art.
Figure 3:
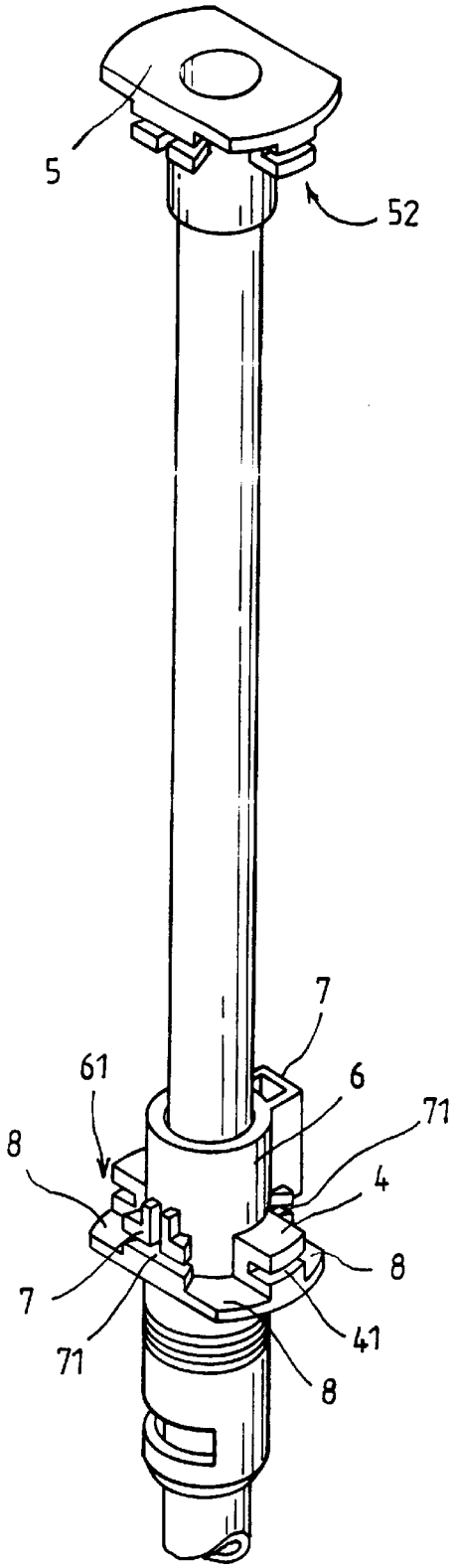
FIG. 3 is a perspective view showing the outer appearance of the umbrella runner of FIG. 2.
Figure 4:
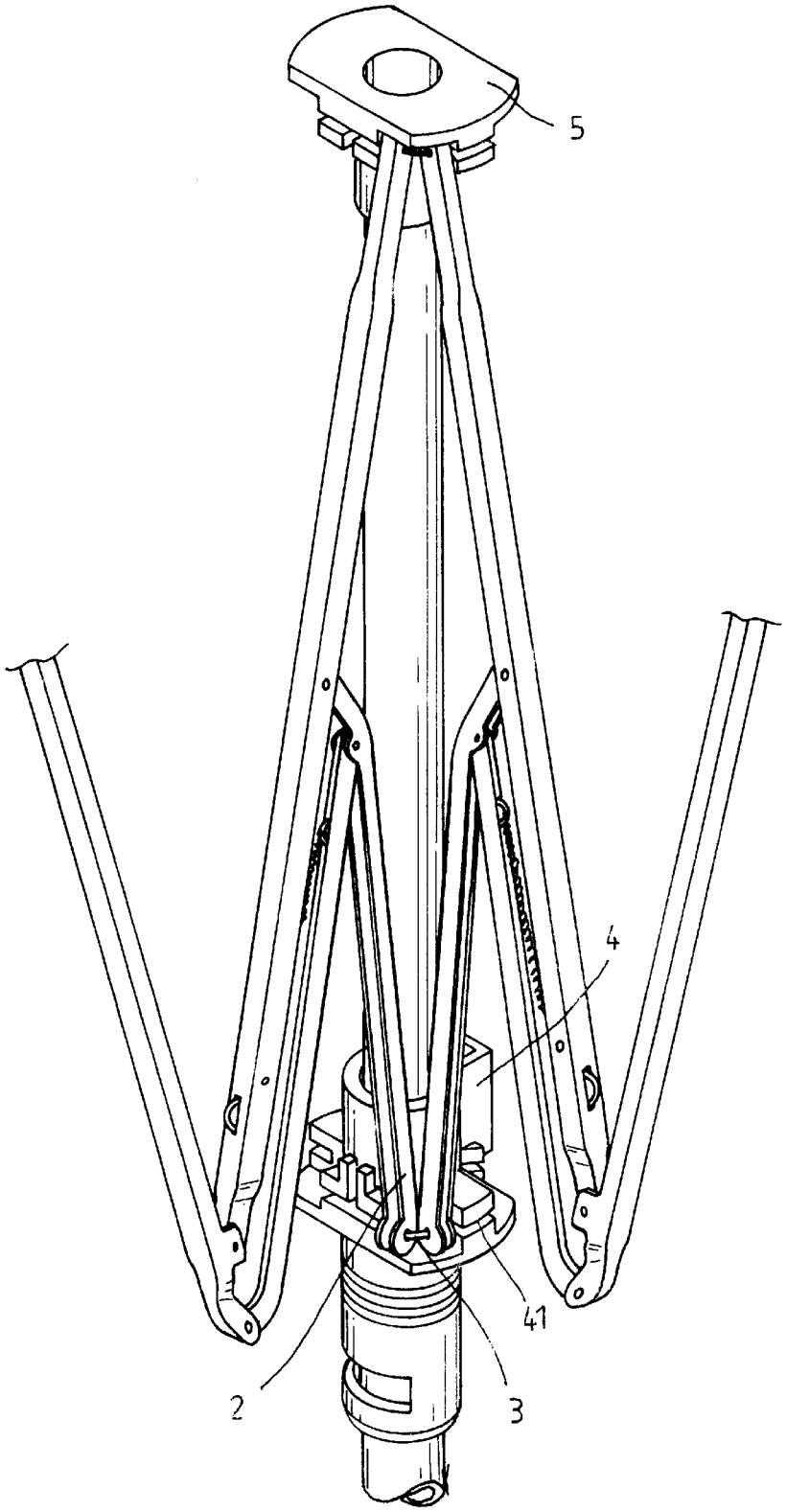
FIG. 4 is a perspective view showing an umbrella stretcher system using the runner of the invention.

Referring to FIGS. 2 to 4, the present invention aims at the improvement of an umbrella runner (6). It primarily consists of two thick partition flanges (4) disposed on opposite sides of the runner and a circumferential groove (41) formed on the outer surface of each partition flange (4). Two coupling portions (7) are disposed on opposite sides of the runner, angularly spaced from the thick partition flanges (4). The coupling portions (7) each have a circumferential groove (71) formed in the outer surface thereof. These two partition flanges in conjunction with the two coupling portions (7) divide the top face (61) of the runner (6) perpendicular to the longitudinal axis into four spaced compartments (8). Each compartment (8) accommodates the inner end of two stretcher assemblies (2) and thus eight stretcher ends in total dwell in the runner (6) to form an umbrella stretcher system having eight stretcher assemblies. Each inner end is provided with a hole through which a steel wire (3) passes to fix the inner end in position. The steel wire is routed through the circumferential grooves (41 and 71) on the outer surface of partition flanges and coupling portions.

From the above description, evidently the invention can provide a better strength by means of a simplified construction. It eliminates the need of forming openings on a thin flange and thus significantly reduces the possibility of breaking. Furthermore, it provides convenience in assemblage. Also, it can reach a compact size when an umbrella is collapsed due to less flanges. As a result, the invention can promote practical value in use. In addition, the top cap (5) of the umbrella stretcher system has a lower face (52) built to have a configuration corresponding to the top face (61) of the runner that it can mate with the inner ends of main umbrella stretchers of the stretcher assemblies (2) and achieve the maximum effect.

What is claimed is:

1. An umbrella runner and stretcher coupling system comprising:

a top cap secured on an umbrella shaft;

a runner slidably mounted on the umbrella shaft, said runner having a top face formed with a pair of opposing thick partition flanges and a pair of opposing coupling portions extending therefrom, said pair of opposing thick partition flanges being respectively angularly spaced from said pair of coupling portions and defining four angularly spaced compartments between each adjacent thick partition and coupling portion, said runner having a groove formed in a circumferential portion in each said thick partition and said coupling portion;

a plurality of stretcher assemblies respectively coupled between said top cap and said runner, said plurality of stretcher assemblies being arranged in pairs, end portions of each pair of said stretcher assemblies being disposed in a respective one of said angularly spaced compartments; and, a steel wire disposed in said groove of each of said thick partitions and said coupling portions, said steel wire passing through said end portions of each of said pair of stretcher assemblies to secure said plurality of stretcher assemblies to said runner.

2. The umbrella runner and stretcher coupling system as recited in claim 1, wherein said top cap has a lower face formed with a pair of opposing thick partition flanges and a pair of opposing coupling portions extending therefrom, said pair of opposing thick partition flanges of said top cap being respectively angularly spaced from said pair of coupling portions of said top cap and defining four angularly spaced compartments between each adjacent thick partition and coupling portion of said top cap, said top cap having a second groove formed in a circumferential portion in each said thick partition and said coupling portion of said top cap, corresponding end portions of each pair of said stretcher assemblies being disposed in a respective one of said angularly spaced compartments of said top cap, a second steel wire being disposed in said second groove of each of said thick partitions and said coupling portions of said top cap, said steel wire passing through said corresponding end portions of each of said pair of stretcher assemblies to secure said plurality of stretcher assemblies to said top cap.

* * * * *